US005961252A

United States Patent [19]

Mercer et al.

[11] Patent Number: 5,961,252

[45] Date of Patent: Oct. 5, 1999

[54] UNDERGROUND UTILITY INSTALLATION TENSION MONITORING ARRANGEMENT AND METHOD

[75] Inventors: John E. Mercer, Kent; Peter H. Hambling, Bellevue, both of Wash.

[73] Assignee: Digital Control, Inc., Renton, Wash.

[21] Appl. No.: 08/953,923

[22] Filed: Oct. 20, 1997

[51] Int. Cl.[6] ..... F16L 1/00

[52] U.S. Cl. ..... 405/175; 175/53; 405/174

[58] Field of Search ..... 405/168.3, 177; 175/53, 50; 73/862.44, 800

[56] References Cited

U.S. PATENT DOCUMENTS

| | | | |
|---|---|---|---|
| 3,451,491 | 6/1969 | Clelland | 175/53 X |
| 3,648,282 | 3/1972 | Kelly | 405/177 X |
| 3,789,511 | 2/1974 | Groom et al. | 73/151 X |
| 3,876,972 | 4/1975 | Garrett | 175/50 X |
| 4,453,603 | 6/1984 | Voss et al. | 175/53 |
| 4,692,063 | 9/1987 | Conti | 405/177 |
| 4,927,232 | 5/1990 | Griffiths | 350/96.29 |
| 4,939,939 | 7/1990 | Vemmer | 73/862.44 |
| 5,000,619 | 3/1991 | Kordahi | 405/168.3 |
| 5,023,845 | 6/1991 | Crane et al. | 73/800 X |
| 5,259,252 | 11/1993 | Druse et al. | 73/862.291 |
| 5,322,997 | 6/1994 | Lambert et al. | 73/865.3 X |
| 5,483,607 | 1/1996 | O'Keefe | 385/11 |

*Primary Examiner*—Dennis L. Taylor
*Attorney, Agent, or Firm*—Mike Pritzkau; Stephen C. Shear

[57] ABSTRACT

An improved method of operating a drilling system for purposes of installing an underground line and associated apparatus are disclosed. The drilling system includes a drill rig which is positionable at a drilling site and a drill string which is configured for extension by the drill rig such that the drill string is extendable to a predetermined location in a way which forms a pilot bore and which is further configured for retraction, such that one end of a line may be attached to the drill string at the predetermined location and pulled through the pilot bore from the predetermined location to the drill rig as the drill string is retracted. The improvement comprises monitoring tension levels in the line during retraction which tension levels are caused by the force of retraction on the line and transmitting the tension levels to an above ground location for use in establishing the condition of the line as it is installed underground. The associated apparatus includes means for monitoring tension levels in the line caused by the force of retraction on the line and means for transmitting the tension levels to the above ground location.

12 Claims, 3 Drawing Sheets

UNDERGROUND UTILITY INSTALLATION TENSION MONITORING ARRANGEMENT AND METHOD

BACKGROUND OF THE INVENTION

The present invention relates generally to the installation of underground utility lines and more particularly to an arrangement for monitoring the tension or force applied to a utility line as it is installed through an underground bore such that exposure of the utility line to damaging levels of tension can be avoided.

The use of horizontal boring tools for the purpose of installing, for example, underground utility lines is increasingly popular due to several factors including recent improvements in horizontal boring tool guidance technology, As an example, see copending U.S. application Ser. No. 08/835,834 entitled SYSTEMS, ARRANGEMENTS AND ASSOCIATED METHODS FOR TRACKING AND/OR GUIDING AN UNDERGROUND BORING TOOL which is incorporated herein by reference. In the installation of an underground line using a boring tool, a pilot bore is typically drilled from the location of a drill rig to a pit or location at the far end of the drill run. It should be appreciated that drilling of the pilot hole may be accomplished with either guided or unguided boring tools. In either case, following drilling of the pilot bore, the drill string remains present in the pilot bore. In most instances, a method is employed in which the pilot bore is drilled having a diameter which is smaller than the diameter of the line to be installed. Thereafter, a reaming operation is performed in which the bore is brought to a suitable size while the utility line is installed. Several advantages are attendant to this method. In a first advantage, drilling a large borehole is avoided since it is known that large drill heads are difficult to steer. In a second advantage, since the drill rig is pushing on the drill string during drilling (i.e., creating compression), the amount of force which may be applied to the drill string is limited by problems such as, for example, buckling of the drill string. In contrast, during the reaming operation, substantial pulling force may be applied to the drill string since the latter is under tension. A typical prior art reaming process will be described in detail immediately hereinafter.

Referring to FIG. 1, a prior art reaming apparatus, generally indicated by the reference numeral 12, is being used in the installation of a utility line 14 in a previously drilled pilot bore 16. Utility line 14 may comprise, for example, a gas line or an electrical cable. A drill string 18 remains in pilot bore 16 following the drilling operation. A reamer 20 is typically installed on drill string 18. The reamer includes a plurality of nozzles and/or cutting picks (none of which are shown). As mentioned previously, drilling of pilot bore 16 is accomplished with a drill head (not shown) installed on the drill string. After reaching the far end of the drilling run, the boring tool is accessed (usually in a pit) and removed from the drill string. Reamer 20 is then installed on the drill string. Line 14 is connected with reamer 18 in any suitable manner using, for example, a Kellums grip 22 and a swivel arrangement 24. Many other suitable arrangements may be found for use in attaching the line to the reamer.

Still referring to FIG. 1, during installation of line 14, drill string 16 is retracted towards the drill rig in the direction indicated by an arrow 26 while the drill string rotates in a suitable direction as indicated by an arrow 28. Of course, reamer 20 is rotated and advanced by the associated actions of the drill string. At the same time, a drilling slurry (not shown) is pumped down drill string 18 and is ejected from the nozzles present on the reamer. The drilling slurry serves to (1) provide cutting action as it is ejected from the nozzles, (2) lubricate reamer 20, (3) provide cooling, (4) lubricate line 14, (5) provides soil stability and (6) viscously support removed soil (not shown) in a mixture with the slurry and is ultimately ejected from the borehole. Advancement of the reamer, in turn, pulls utility line 14 through the reamed pilot bore while swivel 24 serves to isolate the line from the rotation of the reamer.

Having described the manner in which an underground utility line is installed in accordance with the prior art, it should be appreciated that a significant problem may be encountered. Specifically, as mentioned, the drill rig is capable of exerting substantial pulling force on the drill string during the reaming/installation operation. In the event, for example, that the utility line binds within the pilot bore, the utility line may itself be exposed to a excessive portion of the pulling force. In fact, the utility line may be subjected to tension levels which result in damage to the line. Such damage may result in premature failure of the line or in breaking the line at some unknown underground location. In either case, the entire drilling and installation process usually must be repeated at significant expenditure.

As will be seen, the present invention provides a highly advantageous, heretofore unseen tension monitoring arrangement and associated method which solves the foregoing problems and which provides still further advantages.

SUMMARY OF THE INVENTION

As will be described in more detail hereinafter, there is disclosed herein an improved method of operating a drilling system for purposes of installing an underground line and an associated apparatus. The drilling system includes a drill rig which is positionable at a drilling site and a drill string which is configured for extension by the drill rig such that the drill string is extendable to a predetermined location in a way which forms a pilot bore and which is further configured for retraction, such that one end of a line may be attached to the drill string at the predetermined location and pulled through the pilot bore from the predetermined location to the drill rig as the drill string is retracted. The improvement comprises monitoring tension levels in the line during retraction which tension levels are caused by the force of retraction on the line and, thereafter, transmitting the tension levels to an above ground location for use in establishing the condition of the line as it is installed underground.

The associated apparatus of the present invention includes means for monitoring tension levels in the line caused by the force of retraction on the line and means for transmitting the tension levels to the above ground location.

BRIEF DESCRIPTION OF THE DRAWINGS

The present invention may be understood by reference to the following detailed description taken in conjunction with the drawings briefly described below.

DETAILED DESCRIPTION OF THE INVENTION

Figure 1:
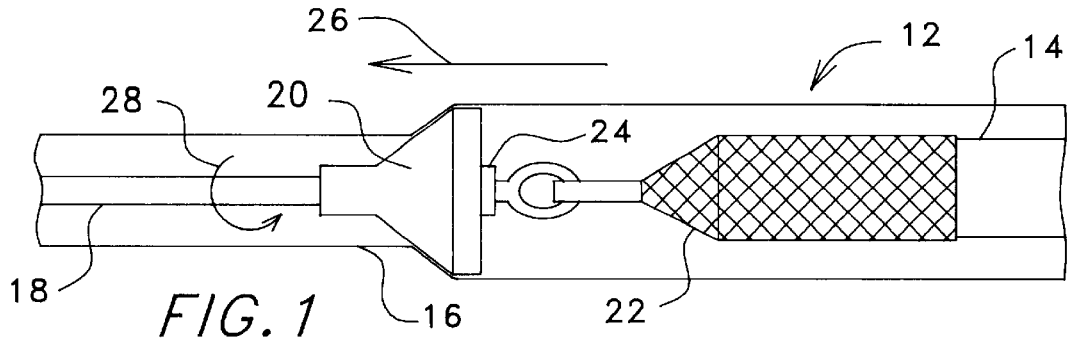
FIG. 1 (PRIOR ART)
FIG. 1 is a diagrammatic elevational view, in cross-section, of a prior art apparatus for use in performing a reaming operation for purposes of installing a utility line.
Figure 2:
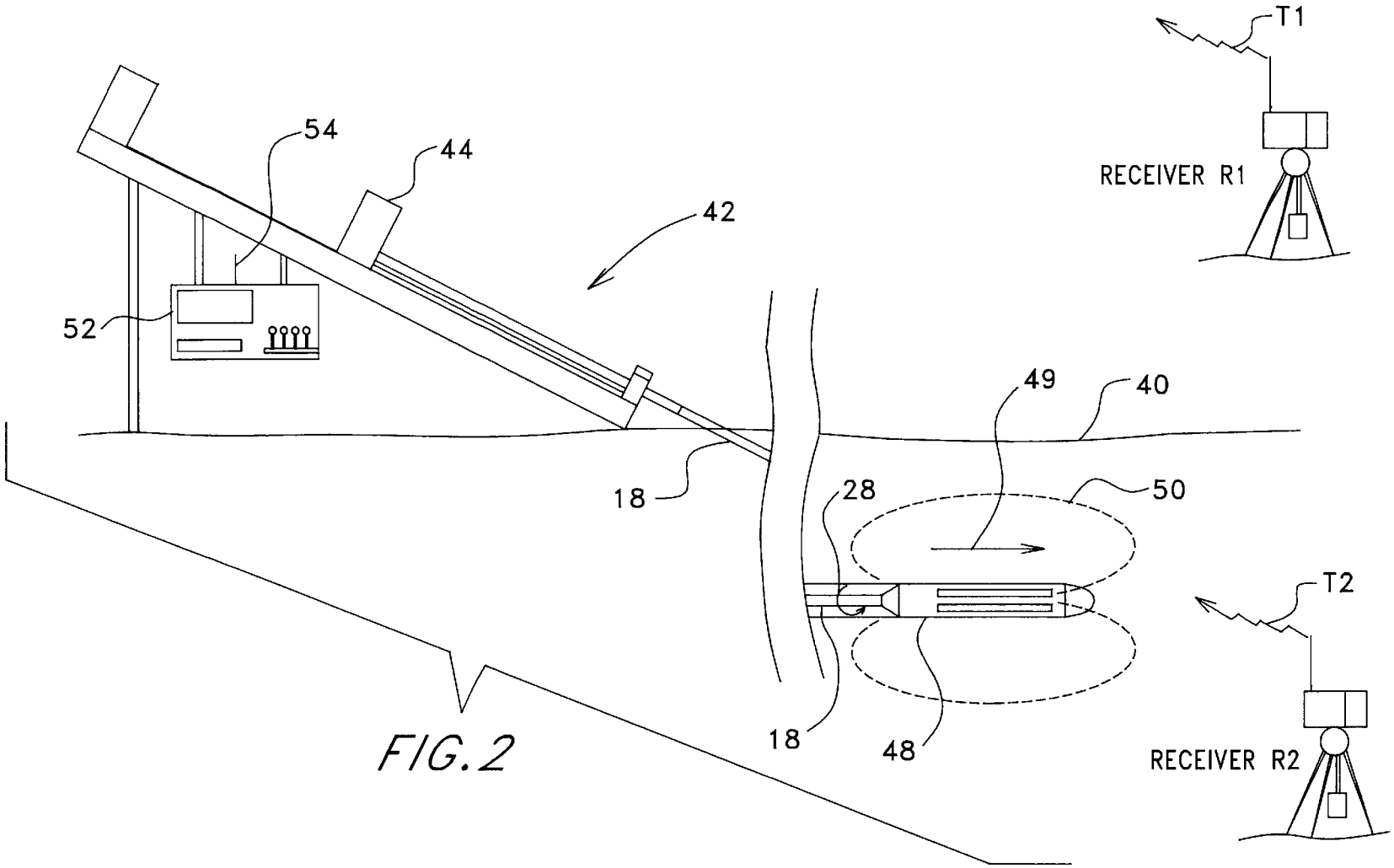
FIG. 2 is a diagrammatic elevational view of a region of ground illustrating a horizontal boring operation being performed by a boring tool affixed to a drilling system such that the position of the boring tool may be located using a transmitted locating signal.

Having described FIG. 1, attention is now directed to FIG. 2 which illustrates a region of ground 40 in which a boring operation is being performed in accordance with the above incorporated U.S. application as part of an overall installation procedure for an underground line such as, for example, a utility line. The boring operation is performed using a drilling system 42. The latter includes a drill rig 44 with previously described drill string 18 extending therefrom to a boring tool 48. Operational details regarding drilling and steering the boring tool will not be provided herein since such details are well known in the art. During the drilling operation, as the drill string is extended to move boring tool 48 in the direction indicated by an arrow 49, a locating signal 50 is transmitted from the boring tool to receivers R1 and R2 positioned on the surface of the ground. In accordance with the above incorporated application, the position of the boring tool may be determined based upon certain characteristics of locating signal 50 at R1 and R2 whereby the location of the boring tool within region 40 as well as the underground path followed by the boring tool may be established and displayed at drill rig 44, for example, on a display 52. Information is transmitted from R1 and R2 to the drill rig via telemetry signals T1 and T2, respectively. In addition, information regarding certain parameters of the boring tool such as, for example, pitch (an orientation parameter) and temperature are encoded onto locating signal 50 during drilling for receipt by R1 and R2. This information is thereafter transmitted to drill rig 44 via T1 and T2, for receipt by an antenna 54 at the drill rig. Along with the drilling path, any parameter of interest in relation to drilling such as, for example, pitch may be displayed on display 52.

Figure 4:
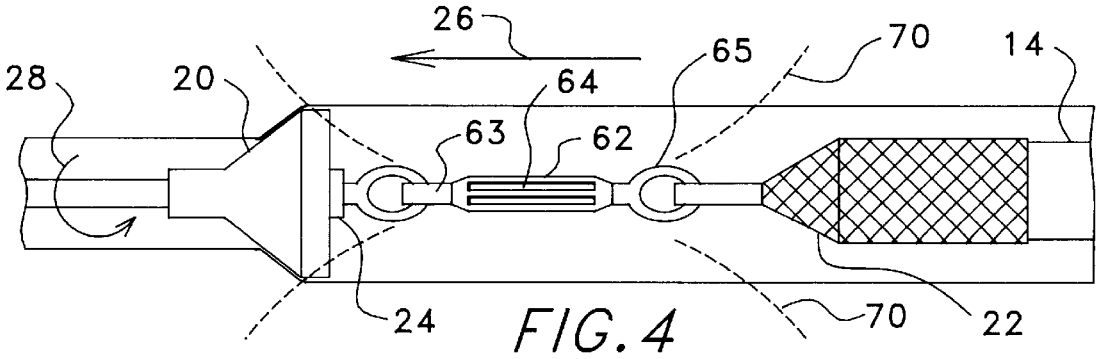
FIG. 4 is a more detailed diagrammatic elevational view illustrating the tension monitoring arrangement of FIG. 3 in relation to the drill string of the drilling system and the line being installed.
Figure 3:
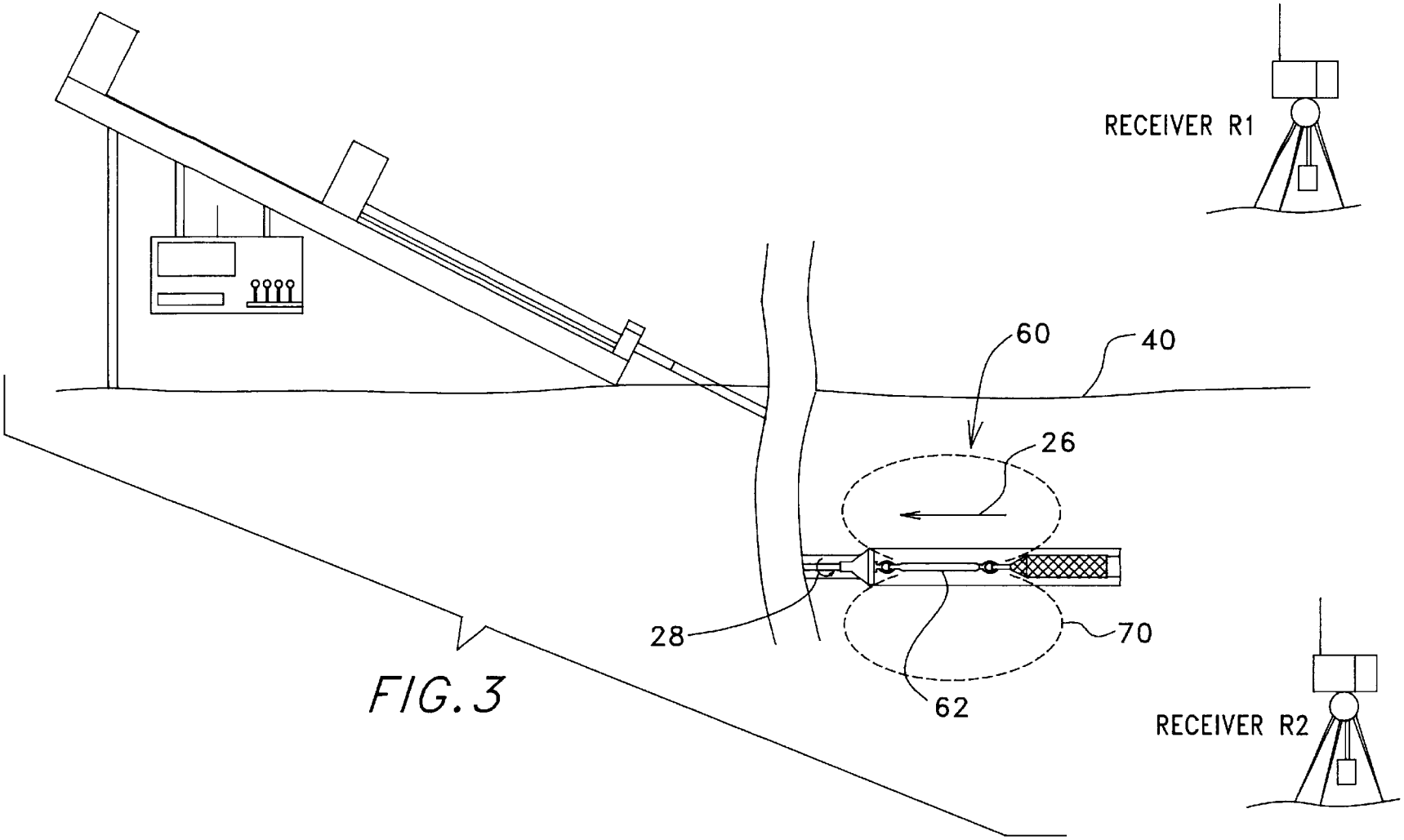
FIG. 3 is a diagrammatic elevational view of the region of FIG. 2 illustrating a utility line being installed during a reaming operation such that a tension monitoring arrangement, which is manufactured in accordance with the present invention, may be located using a locating signal which is transmitted from the tension monitoring arrangement.

Referring now to FIGS. 3 and 4, a utility line installation operation is illustrated being performed in region 40. Since the utility line installation operation depicted in FIGS. 3 and 4 employs a number of components which are also used in the operations depicted in FIGS. 1 and 2, like reference numbers have been applied to like components wherever possible and the reader is referred to previously appearing descriptions of these components. In addition to utilizing drilling system 42 including drill rig 44 and drill string 18, a tension monitoring arrangement which is manufactured in accordance with the present invention is generally indicated by the reference numeral 60. The latter will be described in detail immediately hereinafter.

Referring solely to FIG. 4, tension monitoring arrangement 60 includes a housing 62 which is attached by a first eye 63 to swivel 24 of reamer 20. A second, opposite eye 64 of arrangement 60 is attached to Kellums grip 22 which is, in turn, pulling line 14. Housing 62 includes a plurality of slots 64 that are sealed with a radio frequency transparent material such as, for example, epoxy resin for reasons to be described. It is noted that, in this embodiment, housing 62 carries the force required to pull line 14 through the ground. In other embodiments, it should be appreciated that the tension monitoring arrangement may be configured in such a way (not shown) that the pulling force is primarily carried by a member which is internal to the housing. With the exception of the presence of tension monitoring arrangement 60, the installation of line 14 proceeds in the manner described above as drill string 18 pulls reamer 20 through the ground in the direction of arrow 26 while rotating in the direction of arrow 28. However, as will be described immediately hereinafter, tension monitoring arrangement 60 cooperates with receivers R1 and R2, and drill rig 44 in a highly advantageous and heretofore unseen way.

Referring again to FIGS. 3 and 4, as mentioned previously, drill rig 44 is capable of exerting tremendous pulling force on drill string 18 during the installation of line 14. This force is readily transferred to line 14 in the event that the latter binds in the borehole due, for example, to insufficient lubrication or significant curvature in the path of the borehole. In accordance with the present invention, tension monitoring arrangement 60 is interposed between drill string 18 and line 14 in a way which provides for direct monitoring of the pulling force to which line 14 is subjected. In a highly advantageous manner, tension monitoring arrangement 60 transmits a locating signal 70 for receipt by receivers R1 and R2. Locating signal 70 originates from circuitry to be described within housing 62 and passes through slots 64. As is the case with previously described locating signal 50, locating signal 70 is therefore useful in identifying the position of arrangement 60 and thereby the position of the leading end of line 14. A further advantage of arrangement 60 resides in encoding certain parameters onto locating signal 70 which relate directly to the installation of line 14. In particular, tension, as measured by arrangement 60, is encoded onto locating signal 70. In this regard, it should be appreciated that parameters which are of extreme interest during the aforedescribed drilling operation (FIG. 2) may be of limited or no interest during the line installation operation (FIG. 3). As a specific example, pitch is typically of considerable interest during line installation while, of course, it is of little or no interest during line installation. In contrast, pulling tension within line 14 is of critical interest during line installation. Therefore, a particular data channel may be devoted to pitch during drilling and to tension during utility line installation. Moreover, certain parameters such as temperature may be of interest and, therefore, transmitted or displayed in an identical manner during both drilling and installation. For this reason, little if any additional hardware is required to implement the highly advantageous features of the present invention with respect to the above ground components of drilling system 42 including drill rig 44 and receivers R1 and R2. In other words, changes may be made at a software level such that, for example, line tension is presented on display 52 during utility line installation as opposed to pitch while temperature is displayed during both drilling and line installation operations. In and by itself, the flexibility of the present invention with regard to the display of one set of parameters while drilling and a different set of parameters while performing line installation is highly advantageous, particularly in view of the ease with which these features may be implemented in certain systems. Moreover, the display of pulling tension permits an operator to discontinue the cable installation process at any time that a maximum specified level of tension on the cable being installed is about to be exceeded. It should be mentioned that the present invention also contemplates the use of audio and/or visual alarms for alerting the operator in the event that maximum pulling tension has been exceeded. In this instance, the maximum pulling tension may be entered into the system at startup. Thereafter, tension monitoring may essentially be automatic without the need to actually display the current tension reading. In fact, the system may be programmed to automatically shut down in the event that maximum tension is even momentarily exceeded.

Having described the utility of the tension monitoring arrangement of the present invention with regard to the installation of an underground line, it should be appreciated that, if maximum pulling tension is not exceeded for that line, installation of the line proceeds in an uninterrupted manner with resulting confidence that the line has not been damaged during installation at least due to excessive tension. However, in view of the configuration of drilling system 40, further advantages of the present invention become apparent in the event that installation is stopped due to excessive installation tension. Specifically, through the use of receivers R1 and R2 in conjunction with locating signal 70, tension monitoring arrangement 60 and, hence, the leading end of line 14 may be located in region 40. Thereafter, a pit (not shown) may be dug at that location so as to expose the end of line 14. Having done that, line 14 may be removed from Kellums grip 22 and another, new line (not shown) may be placed therein. This new line may then be installed in the remaining portion of the borehole while using tensioning monitoring arrangement 60 in the manner described above. Following completion of installation of the new line, it may be spliced to the original line at its exposed end. In the past, it should be appreciated that many instances of excessive pulling force resulted in breaking the line being installed at some unknown underground location. In such instances, the broken line was usually abandoned and not only the installation operations, but the drilling operations were repeated. In contrast, the present invention advantageously permits a completed portion of an installed line to be placed into service, significantly reducing installation costs in situations such as that described immediately above.

Figure 5:
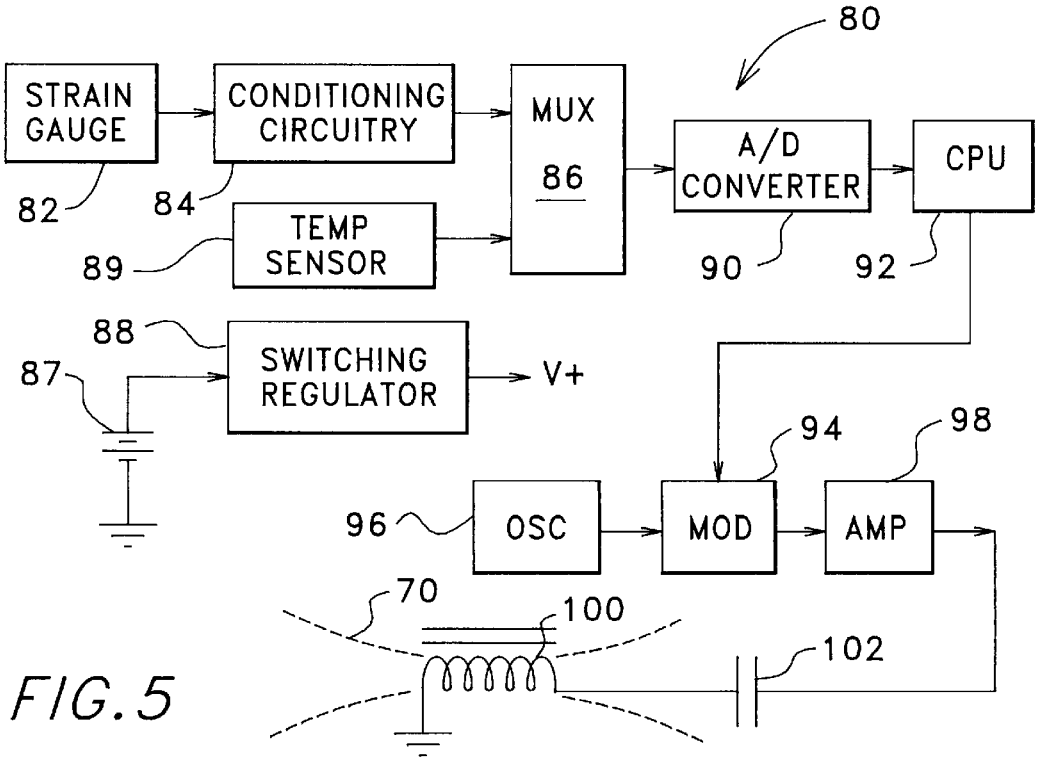
FIG. 5 is a block diagram illustrating one embodiment of an electronics package which is suitable for use in the tension monitoring arrangement of the present invention.

Turning now to FIGS. 1 and 5, an exemplary electronics package 80 is illustrated in block diagram form for use in the tension monitoring arrangement of FIGS. 3 and 4. Package 80 is configured for positioning within housing 62 of tension monitoring arrangement 60 and includes a strain gauge 82 which is located on the interior (not shown) of and in communication with housing 62 in such a way that it is subjected to tension resulting from pulling on line 14, Therefore, strain gauge 82 provides an output that is directly proportional to line tension. The strain gauge output is received by conditioning circuitry 84. The latter may include, for example, amplification and filtering circuitry. Conditioning circuitry 84 then provides a conditioned tension signal to a multiplexer 86. It is to be understood that other parameters of interest may be also be encoded onto locating signal 70 in addition to line pulling tension. As described previously, one such parameter is temperature. Another parameter of interest might be, for example, the condition of a battery 87 which provides power to a switching regulator 88 which, in turn, generates a V+ voltage for use in operating all circuitry within arrangement 60. In the instance of temperature, a temperature sensor 89 may provide a temperature reading to multiplexer 86 indicative of the temperature of housing 62 of the tension monitoring arrangement. The availability of such a temperature reading, for example, on display 52 is important to an operator of the system in situations such as that of reaming through rock formations when the temperature of reamer 20 may potentially rise to extreme levels. Thus, the operator may temporarily halt the reaming operation, allowing the reamer, arrangement 60 and line 14 to cool.

Continuing with a description of electronics package 80, multiplexer 86 provides the tension and temperature readings to an analog to digital (hereinafter A/D) converter 90 which digitizes the analog values for tension and temperature received from multiplexer 86. The A/D converter then passes digital values of these parameters on to a CPU 92 which produces a modulation signal containing the values for use by a modulator 94. The modulation signal could be tones, frequency shifts or other modulation techniques known in the industry. The modulator also receives a carrier frequency of approximately 5–40 kHz from an oscillator 96. In this way, the parameters of interest (tension and temperature, in the present example) are modulated/encoded onto the carrier frequency. The modulated carrier frequency is then received by an amplifier 98, Following amplification, the modulated carrier frequency is emanated from an antenna 100 via a matching capacitor 102 as locating signal 70. Typically, antenna 100 is a dipole antenna such that the locating signal comprises a dipole field, as described in the above incorporated U.S. applications.

It should be appreciated that the block diagram of FIG. 5 represents only one electronics package which is suitable for use in tension monitoring arrangement 60. In accordance with the present invention, this arrangement may be modified in any appropriate manner so long as a locating signal with the parameters of interest impressed thereupon is transmitted from the tension monitoring arrangement.

It is to be understood that while the tension monitoring arrangement of the present invention has been described as being used with the above ground components of one highly advantageous system for tracking an underground device such as a boring tool which emits a locating signal, the utility of the present invention extends to any other form of apparatus which is capable of locating the tension monitoring arrangement and decoding parameters such as pulling tension that are encoded on the locating signal. For example, decoding circuitry may be incorporated (or existing circuitry may be modified where appropriate) in a portable "walk over" locating unit such as the one disclosed in U.S. Pat. No. 5,337,002 which in incorporated herein by reference.

In that the tension monitoring arrangement and associated methods disclosed herein may be provided in a variety of different configurations and modified in an unlimited number of different ways, it should be understood that the present invention may be embodied in many other specific forms without departing from the spirit of scope of the invention. Therefore, the present examples and methods are to be considered as illustrative and not restrictive, and the invention is not to be limited to the details given herein, but may be modified within the scope of the appended claims.

What is claimed is:

1. In a method of operating a drilling system for the purpose of installing an underground line, said system including a drill rig which is positionable at a drilling site and a drill string which is configured for extension by said drill rig such that the drill string is extendable in a way which forms a bore and which is further configured for retraction, such that one end of a line may be attached to an end of the drill string in a predetermined way and pulled through said bore to the drill rig as the drill string is retracted, the improvement comprising the steps of:

a) during said retraction, monitoring tension levels in said line which tension levels are caused by the force of said retraction on the line; and b) transmitting said tension levels to an above ground location using an electromagnetic signal for use in establishing the condition of said line as it is installed underground.

2. The improvement according to claim 1 further comprising the steps of:

c) transmitting an electromagnetic locating signal from said end of the drill string to which the line is attached to said above ground location for use in establishing an underground position of said one end of the line.

3. The improvement according to claim 2 wherein said tension levels are transmitted to the above ground location by modulating said tension levels onto said electromagnetic locating signal.

4. The improvement according to claim 2 wherein said line may be subjected to a maximum tension level without incurring damage, the improvement further comprising the step of:

d) ceasing to retract said drill string if said maximum tension level is monitored during the retraction of the drill string such that the line is undamaged due to excessive retraction tension.

5. The improvement according to claim 4 further comprising the step of:

e) using said locating signal, determining a splicing location of said one end of said line along said pilot bore at which retraction ceased; and f) exposing said one end of the line such that a new line may be attached to said drill string which new line may be retracted by the drill string through the remaining portion of said pilot bore to said drill rig such that the new line and said line may be spliced at said splicing position so as to form said underground line extending from said predetermined location to said drill rig.

6. The improvement according to claim 1 wherein said system includes a boring tool positioned on said drill string during said drilling operation and said drill rig includes display means for displaying at least one orientation parameter relating to said boring tool during the drilling operation, the improvement further comprising:

c) configuring said display means such that said tension levels are displayed in place of said orientation parameter during pulling of said line.

7. In a drilling system for use in installing an underground line, said system including a drill rig which is positionable at a drilling site and a drill string which is configured for extension by said drill rig such that the drill string is extendable in a way which forms a bore and which is further configured for retraction, such that one end of a line may be attached to an end of the drill string in a predetermined way and pulled through said bore to the drill rig as the drill string is retracted, the improvement comprising:

a) means for monitoring tension levels in said line which tension levels are caused by the force of said retraction on the line; and b) means for transmitting said tension levels to an above ground location using an electromagnetic signal for use in establishing the condition of said line as it is installed underground.

8. The improvement according to claim 7 further comprising:

c) means for transmitting an electromagnetic locating signal from said end of the drill string to which the line is attached to said above ground location for use in establishing an underground position of said one end of the line.

9. The improvement according to claim 8 wherein said tension level transmitting means includes means for modulating said tension levels onto said electromagnetic locating signal such that the electromagnetic locating signal also serves to transmit said tension levels.

10. The improvement according to claim 7 wherein said line may be subjected to a maximum tension level without incurring damage, the improvement further comprising:

c) means for establishing that the retraction tension level has reached said maximum tension level such that retraction may be stopped prior to damaging said line.

11. The improvement according to claim 10 further comprising:

e) display means for providing an audio and/or visual warning when said maximum tension level has been reached.

12. The improvement according to claim 7 further comprising:

c) display means for providing an audio and/or visual display representative of said tension levels at said above ground location.

* * * * *

UNITED STATES PATENT AND TRADEMARK OFFICE

CERTIFICATE OF CORRECTION

PATENT NO. : 5,961,252
APPLICATION NO. : 08/953923
DATED : October 5, 1999
INVENTOR(S) : John E. Mercer and Peter H. Hambling It is certified that error appears in the above-identified patent and that said Letters Patent is hereby corrected as shown below:

| | |
|---|---|
| Drawings:<br>FIG.4 | The tension monitoring arrangement illustrated in FIG.4 should be identified by the number 60 with an arrow pointing to the entire figure. |

In the specification, make the following corrections.

| Column # | Line # | Description |
|---|---|---|
| 1 | 62 | Change "drill string 16" to --drill string 18-- |
| 2 | 4 | Change "(5) provides"to --(5) provide-- |
| 2 | 17 | Change "exposed to a excessive portion" to --exposed to an excessive portion-- |
| 3 | 63 | Change "A second, opposite eye 64" to --A second opposite eyelet 65-- |
| 4 | 40 | Change "during line installation" to --during drilling-- |
| 5 | 28 | Change "tensioning monitoring" to --tension monitoring-- |
| 5 | 54 | Change "may be also be encoded" to --may also be encoded-- |
| 6 | 43 | Change "which in incorporated" to --which is incorporated-- |
| Claim 11 | | |
| 8 | 37 | Change "e)" to --d)-- |

Signed and Sealed this

Twenty-eighth Day of August, 2007

JON W. DUDAS
*Director of the United States Patent and Trademark Office*